United States Patent [19]

Donovan

[11] 4,057,002

[45] Nov. 8, 1977

[54] KINETIC BARREL GUN

[75] Inventor: William F. Donovan, Aberdeen, Md.

[73] Assignee: The United States of America as represented by the Secretary of the Army, Washington, D.C.

[21] Appl. No.: 674,469

[22] Filed: Apr. 7, 1976

[51] Int. Cl.[2] ..... F41F 1/00

[52] U.S. Cl. ..... 89/8; 89/1 R

[58] Field of Search ..... 89/8, 7, 1.7, 1 R

[56] References Cited

U.S. PATENT DOCUMENTS

| | | | |
|---|---|---|---|
| 57,607 | 8/1866 | White | 89/8 |
| 477,946 | 6/1892 | Livingston et al. | 89/8 X |
| 2,360,217 | 10/1944 | Francis | 89/8 X |
| 2,397,800 | 4/1946 | Arthur | 89/8 |
| 3,013,472 | 12/1961 | Kahn et al. | 89/8 X |
| 3,457,826 | 7/1969 | Stott | 89/8 X |

FOREIGN PATENT DOCUMENTS

| | | | |
|---|---|---|---|
| 917,369 | 6/1947 | France | 89/8 |
| 233,824 | 1/1925 | United Kingdom | 89/42 B |

*Primary Examiner*—David H. Brown

*Attorney, Agent, or Firm*—Nathan Edelberg; A. Victor Erkkila; Harold H. Card, Jr.

[57] ABSTRACT

A gun having a piston accelerated by a first charge and a projectile mounted to and accelerated relative to the piston by a powder charge on said piston ignited by a firing pin pneumatically actuated by the gases of the first charge. The gases of the first charge travel a convuluted path of decreasing cross-section.

11 Claims, 6 Drawing Figures

KINETIC BARREL GUN

RIGHTS OF THE GOVERNMENT

The invention described herein may be manufactured, used, and licensed by or for the United States Government for governmental purposes without the payment to me of any royalty thereon.

BACKGROUND OF THE INVENTION

1. Field of the Invention

The present invention relates generally to a kinetic barrel gun and more particularly to a double powder charge system, with respect to projectile motion.

2. Description of the Prior Art

In small arms ballistic application, one current avenue of improvement has been to increase the velocity of the projectile. This has generally been the course of development since ballisticians started to recognize the effect on range of muzzle velocity, and particularly since modern study on the terminal or remaining velocity and its relation to gun effectiveness.

Several techniques have been used to increase the projectile motion. One course of approach has been to refine the projectile, which may include boost sustaining means in flight and another was to refine the launcher to fire the projectile at a higher velocity. A third approach concentrated mainly on the use of higher breech pressures and longer barrels than had previously been specified. Other launcher modifications included the use of lighter gases which travelled at a higher velocity, however, propellants capable of generating such a gas are difficult to obtain and use. A more common approach was in the use of multi-stage guns where a plurality of charges were exploded successively as the projectile passed various locations within the barrel, thereby accelerating the projectile as it moved down the barrel length. By this arrangement, the velocity of the projectile through the barrel is maintained at a maximum, since the additional charges supplement the initial charge. These additional charges are needed since energy generated by the initial charge is wasted in overcoming the inertia of the projectile in getting it started.

This latter refinement is exemplified by U.S. Pat. Nos. 57,607; 2,907,250; and 3,013,472. Each of these patents generally uses the concept of multi-stage acceleration. However, each patent is particularly inefficient with respect to the loading operation, the initial pressure gradients, barrel wear and erosion, and gun size. This invention is directed to remedying these deficiencies.

SUMMARY OF THE INVENTION

A kinetic barrel gun system wherein a projectile is fired from the gun by adding velocity to the projectile by pyrotechnic acceleration of a piston-barrel and then by a separate pyrotechnic acceleration of the projectile. The gun consists of a tube having a primary combustion chamber, a piston-barrel chamber, and a barrel guide chamber.

The combustion chamber has a convoluting decreasing cross-section with an eccentrically mounted initial powder charge so as to deliver a volute gas for accelerating a piston-barrel located within the piston-barrel chamber. A projectile loaded on the piston-barrel is accelerated relative to the piston-barrel by a second powder charge which is ignited by a pneumatically triggered firing pin at approximately the peak piston-barrel velocity. The barrel portion primarily mounts the powder charge and projectile, increases the accuracy of trajectory, and decreases wear and erosion.

OBJECTS OF THE INVENTION

An object of the present invention is to provide an efficient mode for loading a double charge gun.

Another object is to provide a kinetic barrel gun having a volute gas accelerating force.

A further object of the invention is to reduce barrel wear and erosion for high velocity projectiles.

Still another object is to increase trajectory accuracy without increasing the overall length of the gun.

Other objects, advantages and novel features of the present invention will become apparent from the following detailed description of the invention when considered in conjunction with the accompanying drawings.

DESCRIPTION OF THE PREFERRED EMBODIMENTS

Figure 4:
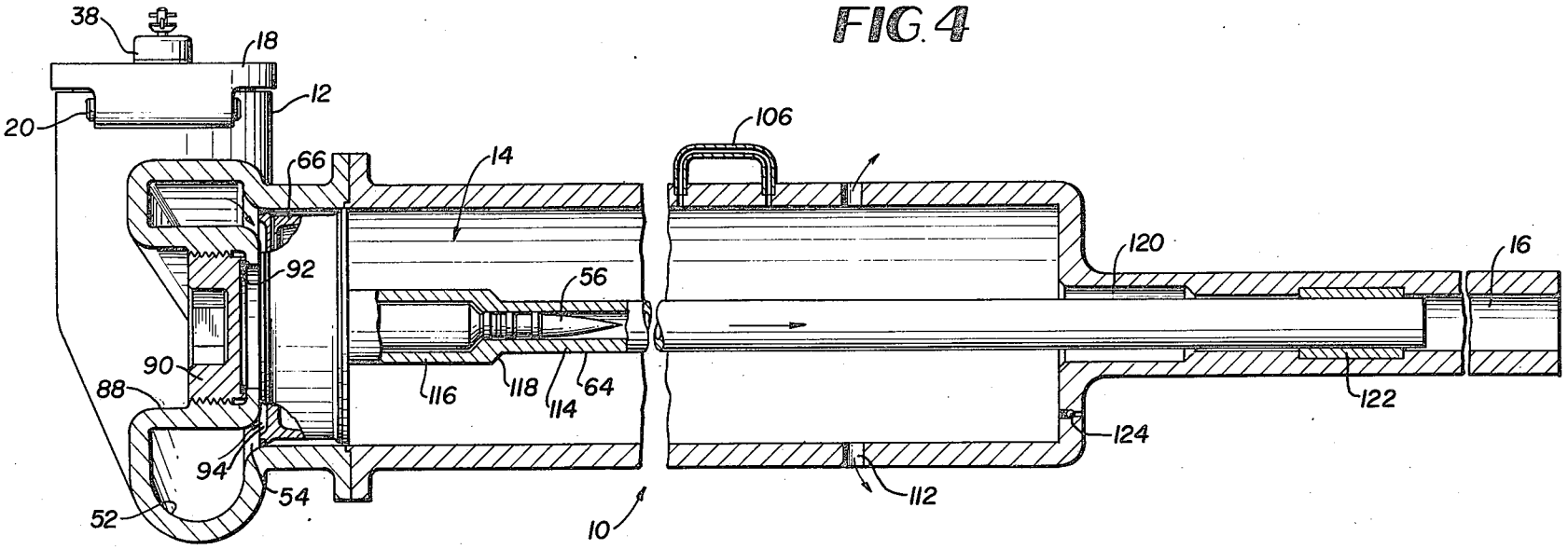
FIG. 4 is a cross-sectional side view of the gun taken along line 4—4 of FIG. 1.

The gun of the present invention, as seen in FIG. 4, consists of a tube housing 10 which is divided into three chambers, i.e., a primary combustion chamber 12, a piston-barrel chamber 14, and a barrel guide chamber 16. The primary combustion chamber 12 contains the means for initially accelerating the projectile, the piston-barrel chamber 14 retains the projectile and contains means for additionally accelerating the projectile, and the barrel guide chamber 16 stabilizes the piston-barrel chamber.

Figure 1:
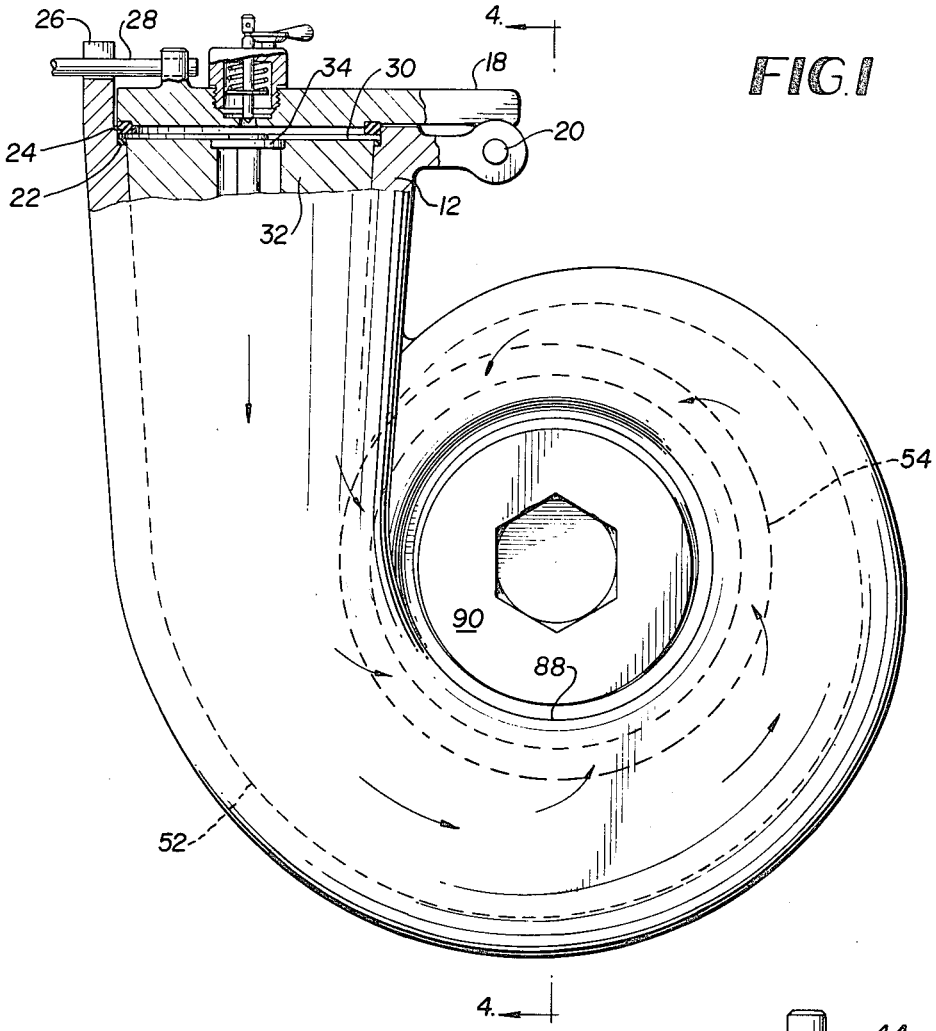
FIG. 1 is an end view of the gun of the present invention.
Figure 2:
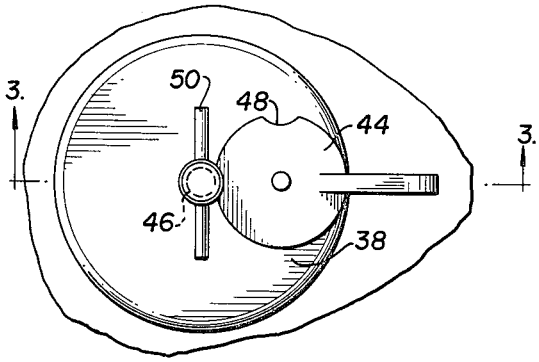
FIG. 2 is a top view of the initial firing pin.
Figure 3:
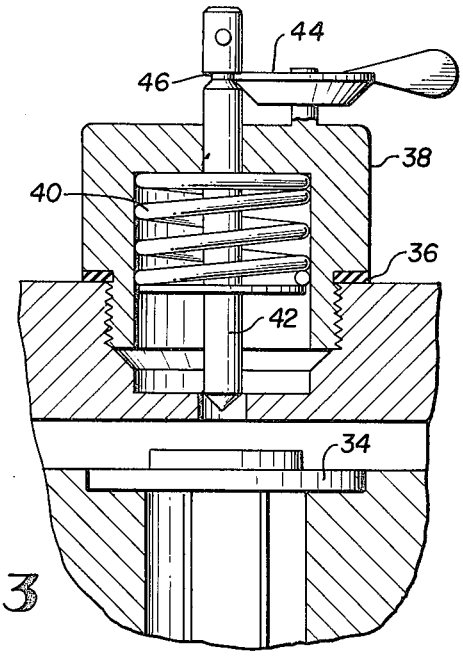
FIG. 3 is a cross-sectional view taken along lines 3—3 of FIG. 2 showing the trigger assembly.

As shown in FIG. 1, the primary combustion chamber 12 has a cover plate 18 pivotally mounted thereto by hinge 20 which, along with conventional seals 22, 24, effect a gas seal. The cover plate has a latch 26 and a latch lever 28 actuated by a handle, not shown. The main cartridge case 30 carries the primary powder charge 32 which is fired by the percussion primer and igniter 34. The primary trigger assembly (see FIG. 3) is isolated and sealed by seal 36 between the primary trigger housing 38 and the cover plate 18. Firing spring 40 operates to propel the firing pin 42, which is released by turning the trigger 44 so as to align the groove 46 and the firing pin 42 with the corresponding notch 48 (see FIG. 2) on trigger 44. Cocking is achieved by pulling the firing pin 42 into position by means of the lifting bar 50.

The main cartridge case 30 is eccentrically mounted relative to the longitudinal axis of the tube 10. The gas therefrom discharged produces a convoluting stream of gas as shown by the arrows in FIG. 1. The end view of the inside wall of the primary combustion chamber, which is shown at 52, is the volute development of the nature that equal increments of distance around the axis progressively reduce the available flow area by equal amounts. The gas will enter piston-barrel chamber 14 through the toroid chamber 54 (see FIG. 4). This is the so-called "logarithmic spiral" common to centrifugal pump design which for incompressible flow, at least, provides a uniform radial pressure in the circumferential direction. It should be noted that the toroid channel is significantly smaller in area than the combustion chamber so as to magnify the pressure gradient. Due to this arrangement, in comparison to transverse pressure gradients, inbore trajectory of the gun will be less affected. In addition, the force generated along the longitudinal axis of the tube by the convoluting stream of gas will be of a larger magnitude than transverse pressure gradients.

Figure 6:
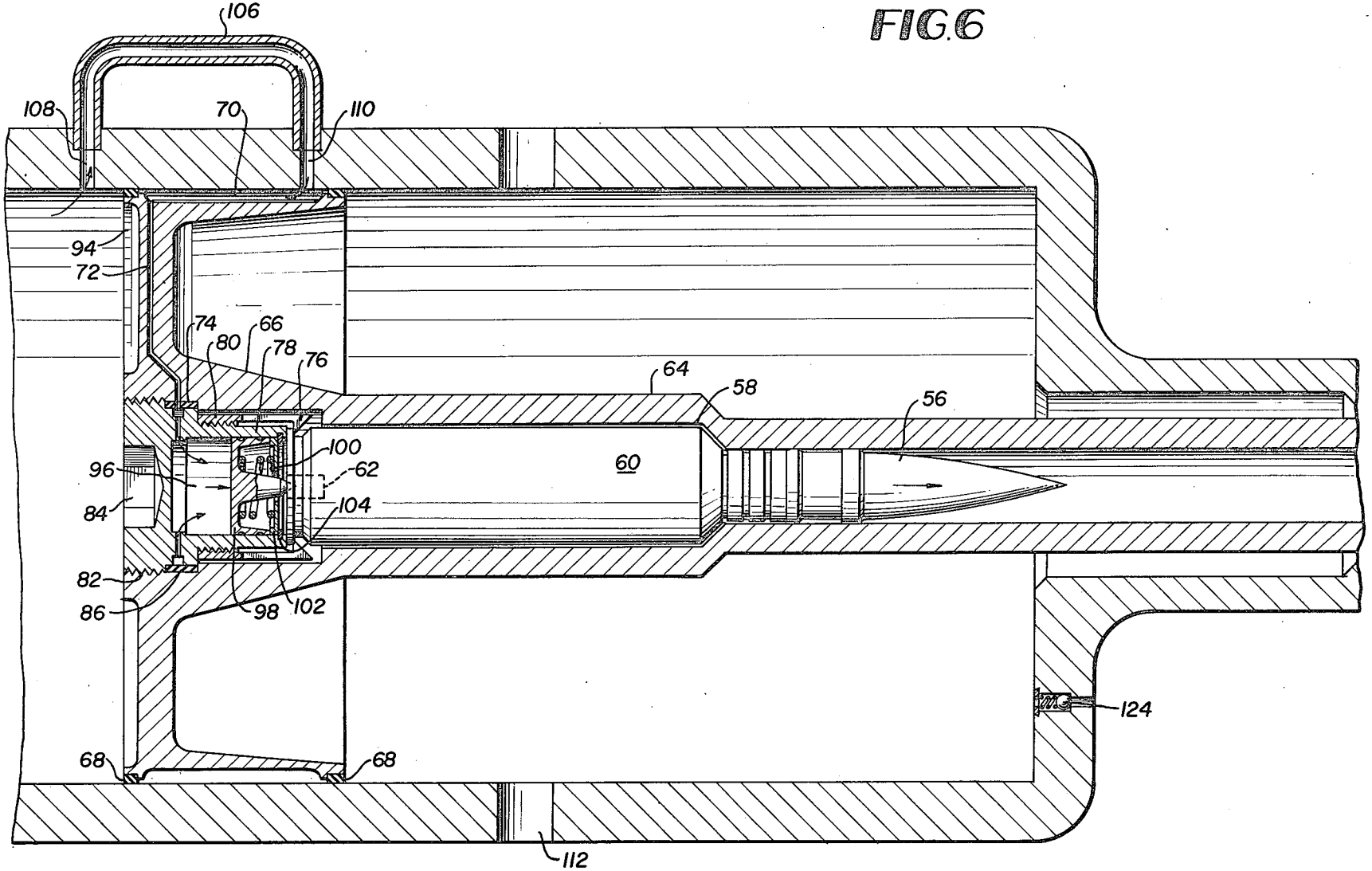
FIG. 6 is an enlarged fragmentary portion of FIG. 5.

In FIG. 6, a cartridge consists of a projectile 56, a case 58, containing an appropriate powder charge 60, and percussion primer igniter 62. The cartridge is conventionally chambered in a barrel 64, which is integral with a piston 66. The piston 66 is fitted to slide in the piston chamber 14 and be slidably sealed by the seal rings 68. A slot 70 is contained in the outer periphery of the piston 66, which is connected to a gas passage 72 leading to a pneumatic trigger assembly 74. The cartridge is held in the barrel 64 by a close fit and with the rear lip of the cartridge engaged by a cantilevered spring pawl 76 of an extractor ring 80 and additionally by the front face of a breech block 78 to which the extractor ring 80 is thready attached. The breech block 78 is attached to the piston 66 by split threads 82, which are engaged and disengaged by turning the breech block 78 via a sunken head recess 84, sealing being accomplished along surface 86. Access to the breech block 78 is through a transverse bore 88 in the primary combustion chamber 12 as seen in FIGS. 1 and 4. The rear end of the bore is closed by screw threaded door 90 which has a gasket 92 forming an air tight seal against the piston chamber.

The gas entering the channel 54 will initially form a pressure gradient only in a confined cut out channel 94 in the rear face of piston 66. The pressure, being confined, will thereby have a greater initial force for overcoming the inertia of the piston.

The sealing, accomplished along surface 86 (see FIG. 6), also seals a trigger gas cylinder 96. A trigger piston pin 98 is slidably mounted and maintained in a retracted position by spring 100 held within the breech block 78 by seat 102 and snap ring 104 (shown in the activated position in FIG. 6). The piston chamber 14 is also provided with a gas channel 106 having an inlet 108 and outlet 110 for permitting flow of gas around the back face of the piston 66 to the piston slot 70 as illustrated in FIG. 6.

At approximately the peak velocity of the piston, the high pressure gases will pass through gas channel 106 to operate on the trigger piston pin 98 which punctures the percussion-igniter 62, thereby accelerating the projectile 56 relative to the piston 66. Relief ports 112 are distributed around the tube 10 to enable the residual gases in the tube 10 to be evacuated by the motion of the piston 66 along the tube, reducing the deceleration effect. A reversible check valve may be installed in port 112 to maintain a one-way passage, if desired. Conventional rifling in the barrel 64 imparts twist to the projectile, therefor necessitating a key and spline, not shown, or equivalent arrangement to prevent the piston 66 and barrel 64 from rotating.

Figure 5:
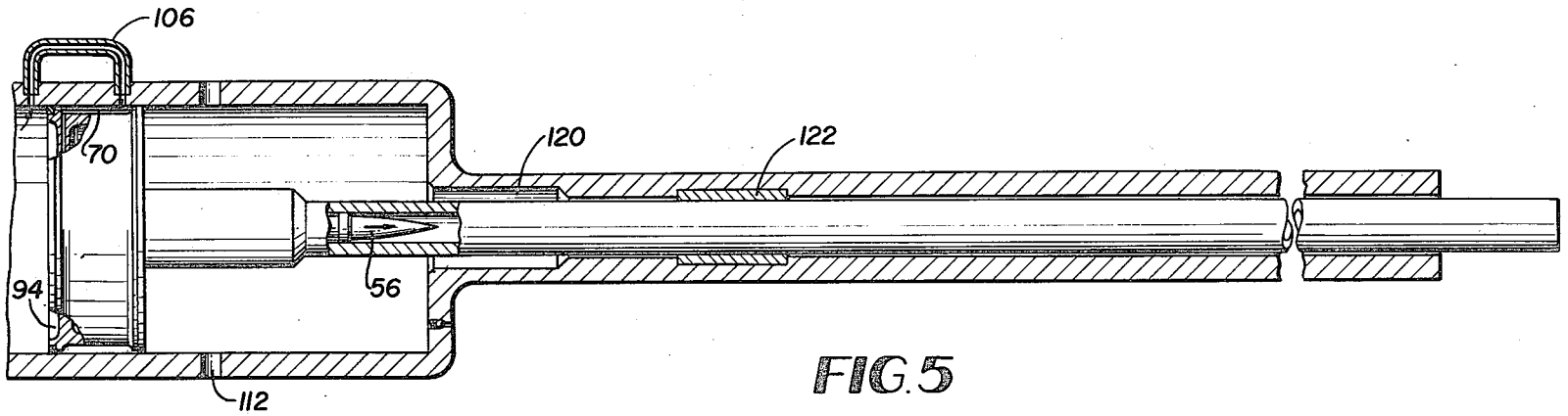
FIG. 5 is a partial view of FIG. 4 at the time of pneumatic actuation of the trigger firing pin.

The barrel 64 (see FIGS. 4 and 5) has two portions, the first portion 114 being of a smaller diameter than the second portion 116 with a shoulder 118 formed therebetween. Integral with and extending forward of the piston chamber is a barrel guide chamber 16. The front wall of the piston chamber 14 and the interior wall of the barrel guide chamber 16 are shaped to form a recess 120 for receiving the larger diameter portion 116 of the barrel 64 for limiting movement of the piston. The barrel guide chamber 16 also has a line bearing 122 for the barrel 66 which, as seen in FIG. 4, is always in contact with the line bearing 122. The barrel 64 is of a greater length than the guide chamber 16 (see FIG. 5), so as to extend the overall length of the gun, increasing the accuracy without increasing the overall dimensions of the gun, in that the barrel 64 extends beyond the end point of the guide chamber 16 in the fully fired position.

A return valve 124 is located in the front wall of the piston chamber 14, for supplying a gas to the front wall of the piston 66 to move the piston 66 back into the home position.

OPERATION

To load the gun, the loading door 90 is unlocked and opened, the piston-barrel assembly 66, 64 is forced back into tube 10 downstream of the piston 66 through the return valve 124, which is mechanically interconnected to a check valve (not shown) in relief port 112. With the piston 66 in its most rearward or home position, the breech block 78 is removed from the piston by rotating via the wrench cavity 84. A cartridge is inserted into the barrel 64 and the breech block 78 is screwed into position, during that process the pawls 76 of the extractor ring 80 are forced over the lip of the cartridge case and locks it against the breech block 78. The door 90 is then closed and locked. It should be noted that the trigger spring 100 initially maintains the trigger piston pin 98 in the retracted position.

The primary combustion chamber cover plate 18 is then unlocked and opened and the main cartridge case 30 is inserted into the combustion chamber 12 with the firing pin 42 held in the cocked position by the positive lock 44 and 46. The cover plate 18 is then closed and latched by lock 26 and 28. The gun is now ready to fire. It should be noted that, if desired, the main cartridge case 30 may be inserted before the projectile cartridge.

Turning the trigger 44 releases the spring 40 and impels the firing pin 42 into the percussion primer-ignition 34. The primary charge 32 fires and the high gas pressure is generated around the volute and operates on the piston-barrel assembly 66, 64. This piston-barrel assembly, including the projectile, barrel, etc., is then explosively driven down the tube 10 under the impetus of 30,000 to 60,000 psi available from standard powder, the barrel being guided by bearing 122.

As the piston seal 68 passes the outlet opening 110 of the channel 106, high pressure gas is delivered from the rear of the piston 66 through the channel 106, along the piston slot 70, through the passage 72, and into the trigger gas cylinder 96. Trigger piston pin 98 is pneumatically driven by the gas into the percussion-igniter primer 62 and charge 60 is fired. This propels the projectile 56 relative to the piston 66 down the barrel 64 in the normal manner with the sum of the velocity of the piston-barrel and that due to its explosive power charge. Using present technology, this can be of the order of 1,000 feet per second from the kinetic barrel acceleration and 2,500 feet per second from the cartridge powder. The moving mass, less the projectile, will then be decelerated by the several forces operating; for example, the momentum rate of the change of the projectile as it leaves the barrel, the compression of the trapped air in the downstream end of the tube and the reverberating compression wave action operating in this volume to further raise the return pressure. Reloading can then be undertaken.

From the preceding description of the preferred embodiment, it is evident that the objects of the invention are attained.

One embodiment has been described. In particular, this gun can be adapted to airborne systems. The immediate application is to wheeled vehicle armament giving the lighter, faster machines the punch of the heavier tracked vehicles.

I wish it to be understood that I do not desire to be limited to the details of constructure as shown and described for obvious modifications can be made by a person skilled in the art.

What is claimed is:

1. A gun for firing a projectile therefrom whereby the acceleration of the projectile is increased within the gun comprising: a tube having a primary combustion chamber and a piston-barrel chamber, said combustion chamber containing first charge means which includes an igniter means and a charge eccentrically mounted relative to the longitudinal axis of the tube to produce a stream of gas from said charge to said piston-barrel chamber and a gas pressure increasing means interposed between said charge and said chamber; said piston-barrel chamber having a piston therein accelerated by said gas from said charge means; said piston having means for retaining a projectile and second charge means for accelerating said projectile relative to said piston; and a firing means activated by said first charge means for igniting said second charge means.

2. The gun according to claim 1 wherein said firing means includes a detachable breech block with said piston; a pneumatically actuated trigger piston pin mounted within said breech block and biasing means between said breech and said piston pin for biasing said piston pin away from said explosive charge means.

3. The gun according to claim 1 wherein said combustion chamber communicates with said piston-barrel chamber through a toroidal channel of significantly reduced cross-sectional area.

4. The gun according to claim 1 wherein said firing means includes a pneumatically actuated pin for igniting said explosive charge means and said pressure increasing means comprises a convoluting means with a larger input area than the output area.

5. The gun according to claim 4 wherein said firing means further includes passage means in each of said piston and tube for allowing a portion of a gas produced by said first charge means to pneumatically actuate said pin via said passage means.

6. The gun according to claim 5 wherein said passage means in said tube includes an inlet leading from said piston-barrel chamber to a channel and an outlet downstream from said channel and said passage means in said piston includes a slot and a gas passage extending to said pin; said slot being in communication with said outlet for a time sufficient to pneumatically actuate said pin for igniting said second explosive charge means; said piston being in a completely sealed relationship with said tube except for said passage means.

7. The gun according to claim 1 wherein said tube further includes a barrel guide chamber extending forward of said piston-barrel chamber and said means for retaining said projectile includes a barrel integral with and longitudinally extending from said piston; a portion of said barrel being slidely received in said barrel guide chamber.

8. The gun according to claim 7 wherein said portion of said barrel is of a greater length than said barrel guide chamber so as to increase the overall length of said weapon.

9. The gun according to claim 7 wherein said barrel has two portions of different diameters; a shoulder formed between said two portions; and said piston-barrel chamber includes a recess for receiving said shoulder to limit the movement of said barrel within said piston-barrel chamber and said guide chamber.

10. A gun for accelerating a projectile therefrom comprising: a housing; a piston located in said housing; first charge means in said housing for accelerating said piston; a projectile mounted on said piston; second charge means retained on said piston for accelerating said projectile relative to said piston; and means actuated by said first charge means for igniting said second charge means including a pin pneumatically actuated by the gases of said first charge means.

11. The gun according to claim 10 wherein said first charge means includes an igniter means and charge eccentrically mounted relative to the longitudinal axis of the housing to produce a stream of gas for accelerating said piston.

* * * * *